United States Patent [19]

Campbell

[11] Patent Number: 4,688,741

[45] Date of Patent: Aug. 25, 1987

[54] WHISKER DISC ASSEMBLY

[75] Inventor: Donnie R. Campbell, Carpentersville, Ill.

[73] Assignee: North American Philips Corporation, New York, N.Y.

[21] Appl. No.: 927,470

[22] Filed: Nov. 6, 1986

[51] Int. Cl.[4] ..... B65H 49/00

[52] U.S. Cl. ..... 242/128

[58] Field of Search ..... 242/128, 129.8, 147 R, 242/129, 130, 131, 129.5

[56] References Cited

U.S. PATENT DOCUMENTS

| | | | |
|---|---|---|---|
| 2,128,487 | 8/1938 | Klein | 242/128 |
| 2,479,826 | 8/1949 | Frick et al. | 242/128 |
| 2,647,704 | 8/1953 | Samler et al. | 242/128 |
| 3,202,380 | 8/1965 | Hosbein | 242/128 |
| 3,425,647 | 2/1969 | Kovaleski et al. | 242/128 |
| 3,972,489 | 8/1976 | Kovaleski | 242/128 |
| 3,997,127 | 12/1976 | Kovaleski | 242/128 |
| 4,017,037 | 4/1977 | Kovaleski | 242/128 |
| 4,062,505 | 12/1977 | Kovaleski | 242/128 |
| 4,171,783 | 10/1979 | Waltemath | 242/128 |
| 4,508,290 | 4/1985 | Bauer | 242/128 |

*Primary Examiner*—Stanley N. Gilreath
*Attorney, Agent, or Firm*—Robert T. Mayer

[57] ABSTRACT

An assembly of a whisker disc and pan on a mounting element for quickly mounting the disc and pan on a wire pay out tree.

4 Claims, 2 Drawing Figures

WHISKER DISC ASSEMBLY

This is an invention which originated in the art of wire making. It is thought, however, not to be limited to such and may well be applicable to other arts in which small diameter wire-like elements are paid out off reels for various purposes.

In one method of putting insulation on electrical wires, bare wire is pulled off a stationary reel and through an oven where it has enamel baked on it. In being paid out the wire unwinds around its stationary reel. A fixed whisker disc is connected at the end of the reel from which the wire is being paid out. In unwinding around its reel the wire engages the filament whiskers of the whisker disc. This prevents the bare wire from looping. A rotatable pan is located in back of the disc. As the bare wire is unwound off its stationary reel it contacts the pan which turns as necessary to relieve the wire of excess strain.

Pay out trees with a number of hollow tube-like reel arbors mounted thereon are used in the foregoing process. Each arbor can hold one reel of wire. It is common for each arbor to have a metal bar welded to its inner walls and disposed across it diameterically. The bar has a threaded hole located at the center of the tube-like arbor. The whisker disc and pan are connected to the bar by means of a thumb screw and washers. The washers serve as shims to attempt to locate the pan properly with respect to the flanged end of the reel.

The foregoing arrangement of mounting the pan and disc is time consuming. It does not locate the pan properly relative to the reel flange with any consistency. Nor does it maintain that relationship for the length of time it takes to pay out a reel. As a result, adjustment is necessary. The method results in undesirable operation of the pan, the breaking of wires, the inability to empty a reel and the scrapping of wire that is left on an unemptied reel.

It is an object of this invention to simplify the mounting of a whisker disc and pan. One of the features of practicing the invention is the consistency with which pans are initially desirably located relative to reel flanges. Another feature is the manner in which the initial relationship is maintained throughout the pay out of a reel. Maintaining pans in the proper location is thought to be responsible for enabling reels to be completely emptied thereby reducing the amount of wire that has to be scrapped.

Another feature of the invention is the speed by which a pan and whisker disc can be mounted on a tree arbor.

One of the advantages of the invention is that it is time saving and consequently has improved production.

In accordance with the invention there is provided a whisker disc assembly which includes a mounting means for insertion into the opening in an arbor of a wire pay out tree. The assembly also includes a plate connected to one end of the mounting means for abutting the flange of a reel of wire mounted on said arbor. This limits how far the mounting means can be inserted into the arbor opening. A round payoff pan with a centrally located bearing is also included in the assembly. A pin is fixedly mounted in the bearing. Connecting means connect the plate and mounting means to the pin. A whisker disc and fastening means are also included. The fastening means fasten the whisker disc to the pin. With this arrangement the pan can freely rotate relative to the mounting means and the disc.

Other objects, features and advantages of the invention will be apparent from the following description and appended claims when considered in conjunction with the accompanying drawing in which:

Figure 1:
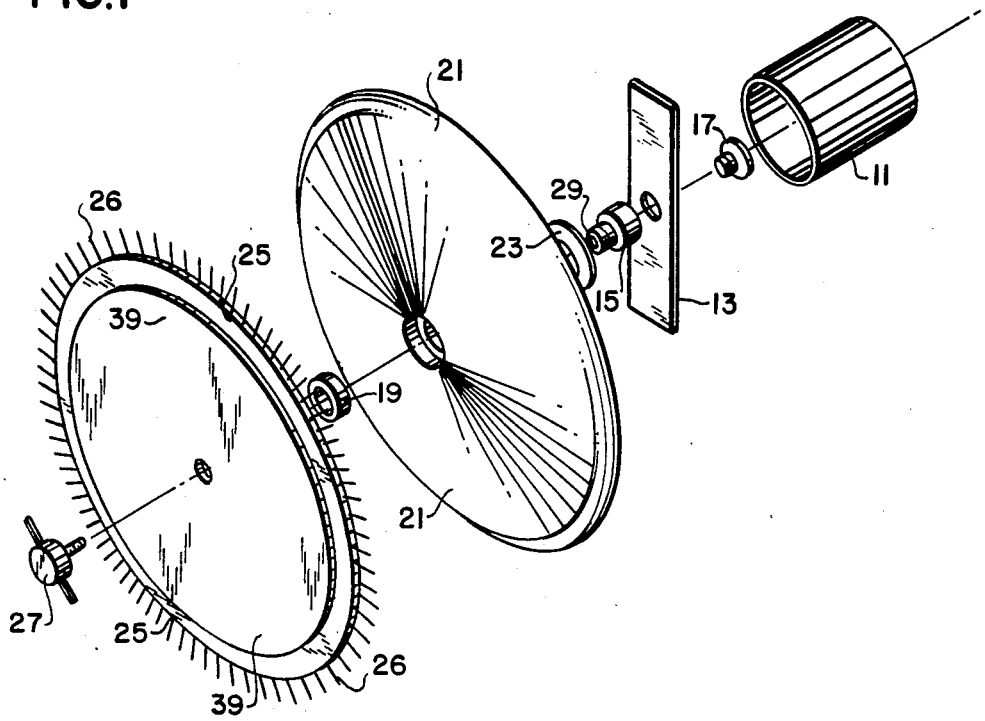
FIG. 1 is an exploded view of the assembly of the invention.

Referring to FIG. 1 there is shown a mounting means in the form of tube-like mandrel 11 having a circular cross-section. Metal plate 13 is welded to one end of mandrel 11. Mandrel 11 and plate 13 are connected to pin 15 by means of connecting means in the form of bolt 17 which is screwed into an internally threaded aperture (not shown) in the back of pin 15. Upon assembly, pin 15 is fixedly held by friction fit in bearing 19 which is force fitted into a central opening of pan 21. Supporting ring 23 riveted to the back of pan 21 supports pin 15. A paper board whisker disc 25 with fiber filament like whiskers 26 is mounted on top of pan 21 by means of fastening means in the form of bolt handle 27 which is screwed into internally threaded aperture 29 in the front of pin 15. For additional strength metal support plates 39 can be used on the front and back of the whisker disc. Only one of these is shown in FIG. 1. Both plates 39 can be seen in FIG. 2.

Figure 2:
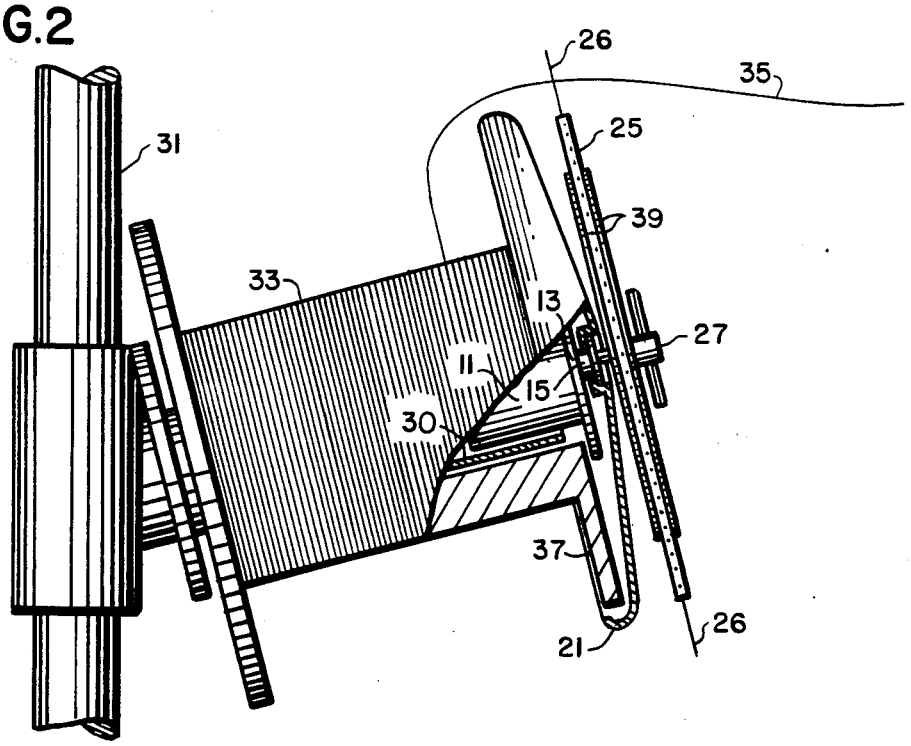
FIG. 2 is a representation of the invention as it looks when in operation.

In FIG. 2 the assembly can be seen as it looks in operation. Mandrel 11 is inserted into the opening in arbor 30 which forms part of pay out tree 31. Mounted on top of arbor 30 is reel 33 from which wire 35 is unwound. As can be seen plate 13 engages flange 37 of reel 33 thereby locating pan 21 as desired with its lip overhanging the edge of reel flange 37.

From the foregoing it should be understood that the mounting of the pan and whisker disc is a simple operation whereby a worker can hold the entire assembly by the handle on bolt 27 and simply insert the mandrel into the arbor on tree 31. Once the unit has been assembled for mounting no further adjustments are necessary in that plate 13 abuts the flange 37 of reel 33 locating the pan as desired. Moreover, the unit maintains this relationship throughout the unreeling of a reel of wire.

It is apparent that various modifications of the above will be evident to those skilled in the art and that the arrangement described herein is for illustrative purposes and is not to be considered restrictive.

What is claimed is:

1. A whisker disc assembly including mounting means for insertion in the opening in an arbor of a wire pay out tree, a plate connected to one end of said mounting means for abutting the flange of a reel of wire mounted on said arbor to limit how far said mounting means can be inserted into said opening, a round payoff pan with a centrally located bearing, a pin fixedly mounted in said bearing, connecting means connecting said plate and mounting means to said pin, a whisker disc and fastening means fastening said whisker disc to said pin, said pan being freely rotatable relative to said mounting means and said disc.

2. A whisker disc assembly as in claim 1, wherein said mounting means is in the form of a round mandrel.

3. A whisker disc assembly as in claim 1, wherein said pin has an end with a threaded aperture in it, said plate having a center hole and said connecting means is a bolt passing through the hole in said plate and being screwed into said aperture in said pin.

4. A whisker disc assembly as in claim 3, wherein said pin has another end having another threaded aperture in it, said whisker disc has a center hole and said fastening means is a bolt passing through the hole in said whisker disc and being screwed into the other aperture of said pin.

* * * * *